US007354040B2

(12) United States Patent
Schneider

(10) Patent No.: US 7,354,040 B2
(45) Date of Patent: Apr. 8, 2008

(54) GAME AND SYSTEM FOR NOSTALGICALLY REPLICATING BASEBALL AND A METHOD FOR PLAYING A BASEBALL GAME

(76) Inventor: Anthony Schneider, 13637 W. 129th Ter., Olathe, KS (US) 66062

( * ) Notice: Subject to any disclaimer, the term of this patent is extended or adjusted under 35 U.S.C. 154(b) by 0 days.

(21) Appl. No.: 11/087,535

(22) Filed: Mar. 23, 2005

(65) Prior Publication Data

US 2006/0214370 A1 Sep. 28, 2006

(51) Int. Cl.
*A63F 3/00* (2006.01)

(52) U.S. Cl. ..... 273/239; 273/244.1

(58) Field of Classification Search ..... 273/244.1, 273/277, 244, 239
See application file for complete search history.

(56) References Cited

U.S. PATENT DOCUMENTS

| | | | | |
|---|---|---|---|---|
| 336,076 | A | | 2/1886 | Aydelott |
| 812,048 | A | | 2/1906 | Kirby |
| 840,584 | A | | 1/1907 | Piper |
| 957,872 | A | | 5/1910 | Ely |
| 1,153,899 | A | | 9/1915 | Elcouin |
| 1,161,770 | A | | 11/1915 | Hatfield |
| 1,170,821 | A | | 2/1916 | Keller |
| 1,177,677 | A | | 4/1916 | Beam |
| 1,259,987 | A | | 3/1918 | Huff et al. |
| 1,530,316 | A | | 3/1925 | Hammons |
| 2,283,578 | A | | 5/1942 | Rogers |
| 2,742,290 | A | | 4/1956 | Fasana |
| 3,528,661 | A | | 9/1970 | Warner |
| 3,957,269 | A | * | 5/1976 | Bouchard ..... 273/244.2 |
| 4,210,335 | A | | 7/1980 | Licciardi |
| 4,504,056 | A | * | 3/1985 | Kanno ..... 273/108.33 |
| 4,773,650 | A | * | 9/1988 | Doughty ..... 273/247 |
| 5,407,204 | A | * | 4/1995 | Meyer, III ..... 273/244.2 |
| 5,762,337 | A | | 6/1998 | Poisson |
| 5,884,914 | A | * | 3/1999 | Lilien ..... 273/244.1 |

* cited by examiner

*Primary Examiner*—Vishu K. Mendiratta
(74) *Attorney, Agent, or Firm*—Patents+TMS, P.C.

(57) ABSTRACT

An educational game and system for nostalgically replicating a baseball game and a method for playing a baseball board game are provided. Two players alternate between the roles of batting and fielding. A series of cards from one deck are turned to advance players around the bases and to accumulate outs. Various decks of cards are used at each player's option to determine the outcome for on-base situations, hitting situations and running situations. Game pieces are used to mark the positions of runners on base and to tally the number of runs scored during a half-inning. An old-fashioned scoreboard is provided to record the total number of runs that are scored at the end of each half-inning. A traditional scorecard is provided to record each play of the game.

8 Claims, 10 Drawing Sheets

GAME AND SYSTEM FOR NOSTALGICALLY REPLICATING BASEBALL AND A METHOD FOR PLAYING A BASEBALL GAME

BACKGROUND OF THE INVENTION

The present invention generally relates to a game and a system for nostalgically replicating baseball and a method for playing a baseball game. More specifically, the present invention relates to an educational game that simulates the sport of baseball and incorporates rules and elements of baseball.

Historically called the "national pastime", baseball is played and viewed by millions of Americans, and an even greater number of people throughout the world. Accordingly, the rules of baseball are widely known. Further, many baseball fans enjoy learning trivia about professional baseball players past and present and enjoy following the statistics that reflect each professional baseball player's performance during each game. The fascination with and love for the game of baseball transcends generations.

Baseball is a sport and/or game that is played outdoors. Two teams of nine players per team play baseball on a field. Equipment is needed to play baseball, namely bats, mitts, balls, and bases. Often, playing baseball is restricted by weather, the number of players that are available to play, the accessibility of baseball equipment, and the amount of space available to play. Baseball is difficult, if not impossible, to play if one or more of the following conditions exist: cold, dark, wet, or snowy weather; an insufficient number of players to perform essential roles on each team; lack of baseball equipment; and/or lack of a field.

To address these difficulties, various devices, systems and methods are known to simulate the game of baseball. However, known devices are often cumbersome and complex because efforts to simulate nuances of the game of baseball fail in a maze of confusion. Known devices also use articles that do not appropriately represent elements of a baseball game and do not simulate the game effectively. In addition, known devices oversimplify the game and, therefore, do not comprehensively simulate the game of baseball. Known devices also fail to incorporate nostalgic elements of the game of baseball.

A need, therefore, exists for a game and a system for nostalgically replicating baseball. Additionally, a need exists for a method for playing a baseball board game. More specifically, the game effectively and comprehensively simulates the game of baseball and incorporates nostalgic elements of the game of baseball.

SUMMARY OF THE INVENTION

The present invention generally relates to a game and a system for nostalgically replicating baseball and a method for playing a baseball game. More specifically, the present invention relates to an educational game that simulates the sport of baseball and incorporates rules and elements of baseball.

In an embodiment of the invention, an apparatus for simulating play of a game of baseball is provided. The apparatus has a game board having a design of a baseball park wherein the game board has positions and a first game piece. Further, the apparatus has a first set of playing cards having offensive cards and defensive cards wherein the offensive cards affect advancement of the first game piece on the positions of the game board and further wherein the defensive cards deter the advancement of the first game piece from the positions on the game board.

In an embodiment, the apparatus has a scoreboard to record runs scored by the first game piece.

In an embodiment, the apparatus has a container to house the first game piece.

In an embodiment, the apparatus has a scorecard to record the placement of the first game piece on the game board.

It is, therefore, an advantage of the present invention to provide a game and a system for nostalgically replicating baseball and a method for playing a baseball game that simulates play of the game of baseball.

A further advantage of the present invention is to provide a game and a system for nostalgically replicating baseball and a method for playing a baseball game which is played indoors. In an embodiment, the apparatus has positions on the game board to track the progress of the first game piece on the game board.

In an embodiment, the apparatus has a positions on the game board to track a number of times the first game piece is deterred from the advancement on the game board.

In an embodiment, the apparatus has positions on the game board to track a score resulting from the advancement of the first game piece.

In an embodiment, the apparatus has a second game piece to tally the effects of the first set of cards.

In an embodiment, a system for electronically simulating a game of baseball is provided. The system has a computer-generated image of a ballpark wherein the image of the ballpark has a baseball infield. Further, the system has a first set of computer-generated playing cards having offensive cards and defensive cards wherein the offensive cards advance a computer-generated baseball player within the baseball infield and further wherein the defensive cards remove the computer-generated baseball player from the baseball infield.

In an embodiment, the system has a computer-generated scoreboard programmed to tally a score by the computer-generated baseball player.

In an embodiment, the system has a computer-generated scorecard programmed to record the position of the computer-generated baseball player.

In an embodiment, the system has a second set of computer-generated playing cards that simulate advanced situations during play of the game of baseball.

In an embodiment, a method for simulating play of a game of baseball is provided. The method has a step of providing a game board having a design of a baseball park wherein the game board has positions representative of first base, second base, third base and home plate wherein a run is scored by complete advancement through the positions of the game board. Further, the method has a step of revealing a series of cards from a first set of playing cards having offensive cards and defensive cards wherein the offensive cards advance a first game piece on the game board and further wherein the defensive cards remove the first game piece from the game board. Still further, the method has a step of tallying the run after the complete advancement of the first game piece.

In an embodiment, the method has a step of recording the run on a scoreboard.

In an embodiment, the method has a step of providing a second set of playing cards having advanced cards that simulate advanced play of the game of baseball wherein the advanced play is distinct from the offensive and the defensive cards.

In an embodiment, the method has a step of providing positions on the game board for tracking a number of times the first game piece is deterred from advancement on the game board.

In an embodiment, the method has a step of providing a scorecard to record the effects of the first set of playing cards.

In an embodiment, the method has a step of providing a second game piece to tally a number of times the first game piece scores a run.

In an embodiment, the method has a step of providing a housing for the first game piece.

In an embodiment, the method provides that the second game piece tallies the run on the game board.

It is, therefore, an advantage of the present invention to provide a game and a system for nostalgically replicating baseball and a method for playing a baseball game which only requires two players.

A further advantage of the present invention is to provide a game and a system for nostalgically replicating baseball and a method for playing a baseball game which may be used in a small area.

A still further advantage of the present invention is to provide a game and a system for nostalgically replicating baseball and a method for playing a baseball game which does not require baseball equipment.

Yet another advantage of the present invention is to provide a game and a system for nostalgically replicating baseball and a method for playing a baseball game which comprehensively incorporates vital elements of the game of baseball.

A still further advantage of the present invention is to provide a game and a system for nostalgically replicating baseball and a method for playing a baseball game which uses articles to represent elements of the game of baseball.

Moreover, an advantage of the present invention is to provide a game and a system for nostalgically replicating baseball and a method for playing a baseball game which is simple to play and to understand.

Yet another advantage of the present invention is to provide a game and a system for nostalgically replicating baseball and a method for playing a baseball game which incorporates nostalgic elements of the game of baseball.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a game and a system for nostalgically replicating baseball and a method for playing a baseball game. More specifically, the present invention relates to an educational game that simulates the sport of baseball and incorporates rules and elements of baseball.

Figure 1:
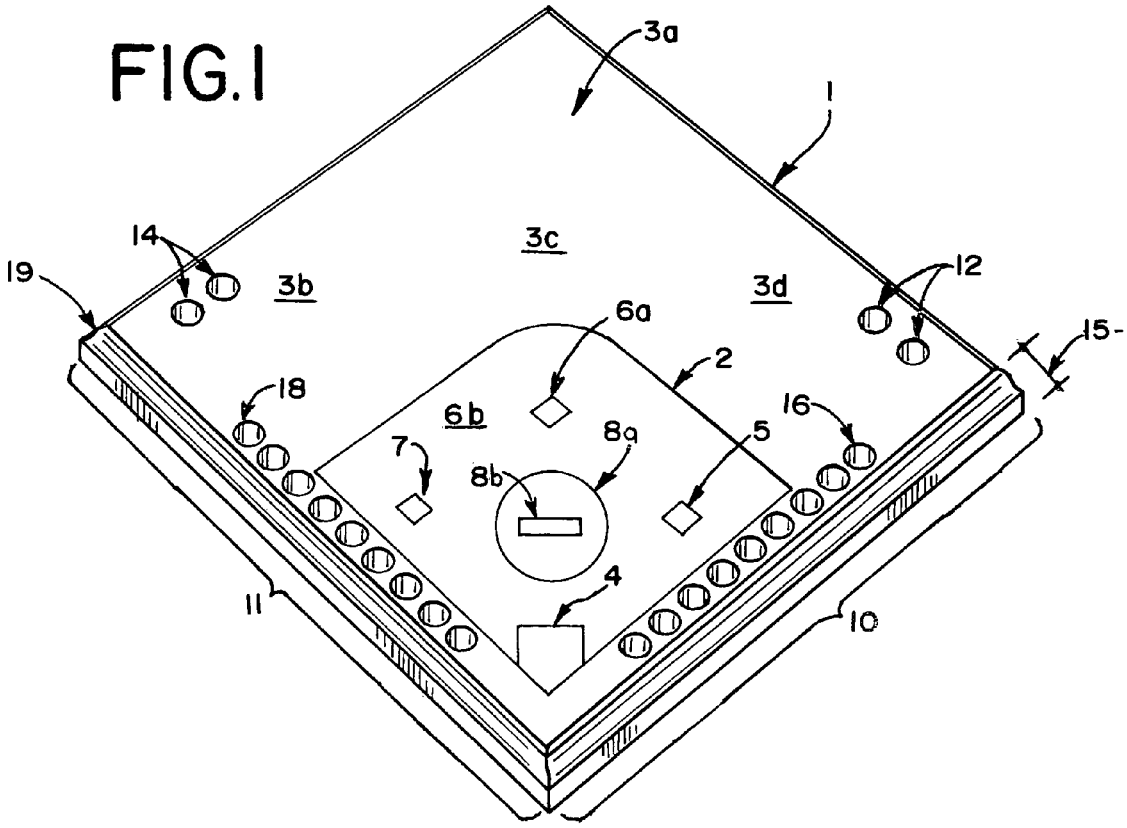
FIG. 1 illustrates a perspective top view of an embodiment of a game board of the present invention.

Referring now to the drawings wherein like numerals refer to like parts, FIG. 1 illustrates a game board 1 that may have an infield area 2 and an outfield area 3*a*. The game board 1 may be square or rectangular in shape and may be made from plastic, wood, metal, cardboard, or the like. In use, the game board 1 may be placed on any horizontal surface, such as a floor or a table top. Further, the game board 1 may have a thickness 15, or alternatively, may be flat. In one embodiment, as shown in FIG. 1, the game board 1 may have a rounded top edge 19 of the game board 1.

The infield area 2 may be square or rectangular in shape with a rounded corner at the center of the outfield area 3*a*. The infield area 2 may be printed on the game board 1 by a printing process or may be formed as a part of the game board 1 if the game board 1 is made from plastic, for example. Further, the top surface of the game board 1 may be textured to replicate the grass and dirt areas of a baseball field. In an embodiment of the game, a fence (not shown) may surround the outfield area 3*a*, and advertisements may be displayed on the fence. The infield area 2 may have a home base position 4, a first base position 5, a second base position 6*a*, a short stop position 6*b*, a third base position 7, and a pitcher's mound position 8*a* that may have a pitcher's rubber mat 8*b*.

The home base position 4, the first base position 5, the second base position 6*a*, the third base position 7, and the pitcher's mound position 8*a* may be printed on the infield area 2 by a printing process or may be formed as a part of the game board 1 if the game board 1 is made from plastic, for example. Alternatively, the home base position 4, the first base position 5, the second base position 6*a*, the third base position 7, and the pitcher's mound position 8*a* may be objects made from plastic, cloth, wood, cardboard, metal, or the like and may be mounted to the game board 1 via an adhesive, a magnet, a staple, a nail or the like. The home base position 4, the first base position 5, the second base position 6*a*, the third base position 7, and the pitcher's mound position 8*a* may accommodate one player game piece 21, which may attach by a magnet, velcro, or a mechanical device such as a clip or a snap, for example. Alternatively, the player game piece 21 may be placed on a position. The outfield area 3*a* of the game board 1 may have a left field position 3*b*, a center field position 3*c* and a right field position 3*d*.

The game may have a person playing the game, a first player (not shown), associated with a visiting team side 10 of the game board 1 and another person playing the game, a second player (not shown), associated with a home team side 11 of the game board 1. The visiting team side 10 may have two "out" receptacles 12, and the home team side 11 may have two "out" receptacles 14. Further, the first player may use a "run" receptacle 16 from a series of receptacles on the visiting team side 10, and the second player may use a "run" receptacle 18 from a series of receptacles on the home team side 11. In an embodiment of the game, the visiting team side 10 and the home team side 10 may each have a total of nine "run" receptacles. Of course, the game board 1 may have any number of "run" receptacles on the visiting team side 10 and the home team side 11.

The "out" receptacles 12 and the "run" receptacles 16 on the visiting team side 10 and the "out" receptacles 14 and the "run" receptacles 18 on the home team side 11 may be holes in the game board 1, may be depressions in the top surface of the game board 1, or may be markings printed on the surface of the game board, for example. Alternatively, the receptacles may be formed out of devices made from plastic, cloth, wood, cardboard, metal, or the like mounted to the game board 1 via an adhesive, a magnet, a staple, a nail or the like.

Figure 2:
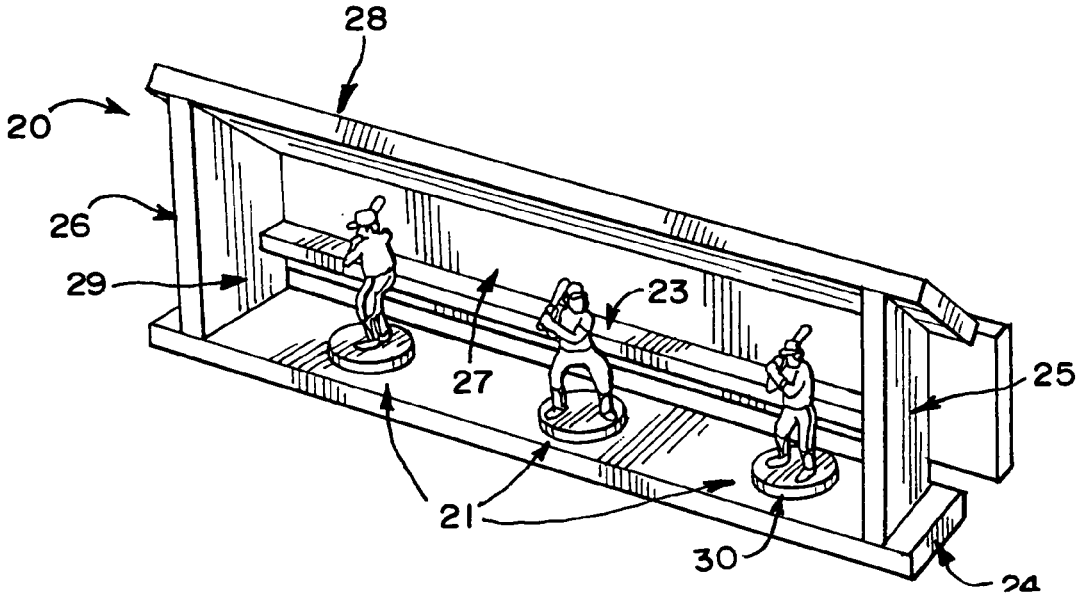
FIG. 2 illustrates a perspective view of a player container in an embodiment of the present invention.

FIG. 2 illustrates a player container 20. The first player may have the player container 20, which may be a different color than the player container 20 for the second player. The player container 20 may contain three or more player game pieces 21. Further, the player container 20 may have a base 24, a first side panel 25, a second side panel 26, a back panel 27, a top 28, and a bench 23. Still further, the player container 20 may have an opening 29 at the front of the player container 20, which may be larger than the back panel 27 of the player container 20.

The player container 20 may be shaped to replicate a traditional baseball dug-out. The player container 20 may be made from plastic, wood, cardboard, metal, or the like and may be sized to contain three or more player game pieces 21. The player game pieces 21 may be made from plastic, wood, rubber, metal, or the like and may be formed to replicate the shape of a baseball player batting, standing or running. Each one of the player game pieces 21 may be on a footing 30 that may support the player game pieces 21. The first player may have player game pieces 21 with baseball uniforms that may be gray or a dark color. Further, the second player may have player game pieces 21 with baseball uniforms that may be white or a light color.

Figure 3:
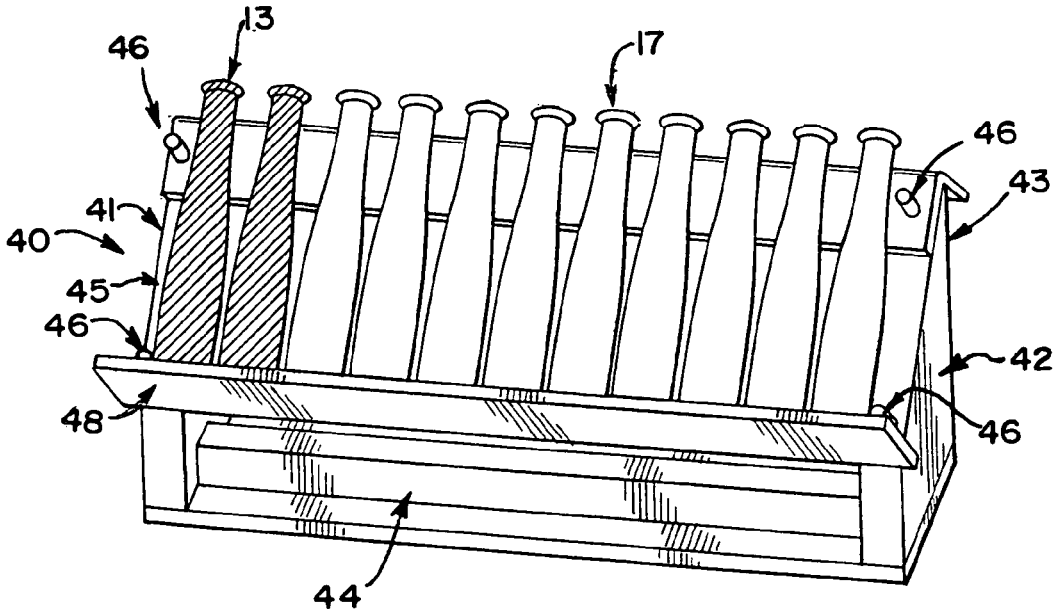
FIG. 3 illustrates a perspective view of a game piece rack in an embodiment of the present invention.

FIG. 3 illustrates a game piece rack 40. The first player may have the game piece rack 40, which may be a different color than the game piece rack 40 for the second player. The game piece rack 40 may have a first end 41, a second end 42, a back panel 43, a front panel 44, and a footboard 48. The game piece rack 40 may have a top surface 45 that may have pins 46 to confine each "run" game piece 13 and each "out" game piece 17, which may rest on the top surface 45 of the game piece rack 40. In an embodiment, nine "run" game pieces 13 may be provided as the anticipated maximum number of "runs" that may be scored during each player's turn and two "out" game pieces 17 may be provided because a third "out" indicates the end of each player's turn.

The game piece rack 40 may be made from plastic, wood, rubber, cardboard, or the like and may be shaped as shown in FIG. 3, or in any configuration that may hold and/or may confine the "out" game pieces 13 and the "run" game pieces 17. The pins 46 on the game piece rack 40 may be made from wood, metal, plastic, rubber, or the like and may be cylindrical dowels, for example. Alternatively, the pins 46 may be configured as a wall or a fence that may confine the "out" game pieces 13 and the "run" game pieces 17.

The "out" game pieces 13 and the "run" game pieces 17 may be made from plastic, rubber, wood, metal, or the like and may be shaped to replicate a baseball bat. The "out" game pieces 13 may be a different color than the "run" game pieces 17 so that the first player and the second player may differentiate between the pieces. Further, the "out" game pieces 13 and the "run" game pieces 17 used by the first player may be a different color than the "out" game pieces 13 and the "run" game pieces 17 used by a second player so that the first player and the second player may differentiate between the pieces.

The game may be played by shuffling and/or mixing a set of batting playing cards 100 (see FIG. 6) and designating the first player as the visiting team and the second player as the home team. The first player may be "up to bat" first, meaning that the first player may begin play by sequentially revealing a series of cards from the set of batting playing cards 100, one at a time and may move game pieces as described in detail below. Each card may advance player game pieces 21 and score runs or record outs according to the card and according to the rules of the game of baseball. The first player may acquire a "run", which is an addition to the first player's score, when a player game piece 21 advances from the first base position 5 to the second base position **6*a* to the third base position 7 to the home base position 4**. The first player may acquire an "out", a mark against the first player, in accordance with the cards described in detail below. When the first player has acquired three "outs", a half-inning may be completed.

Then, the second player may be "up to bat" and may attempt to score runs by revealing cards consecutively from the set of batting playing cards 100 and moving game pieces in the same manner as the first player. The second player may accumulate "runs" and "outs" in the same manner as the first player. When the second player has acquired three "outs", an inning may be over. In an embodiment, the players may alternate play of the game for nine innings, however, the players may play as many innings as desired.

The "run" game pieces 17 may be used to tally the number of "runs" acquired by the first player and/or the second player during each inning of the game. To tally a "run" when "up to bat", the first player may place the "run" game piece 17 from the first player's game piece rack 40 into one of the "run" receptacles 16 on the visiting team side 10 of the game board 1. Further, to tally a "run" when "up to bat", the second player may place the "run" game piece 17 from the second player's game piece rack 40 into one of the "run" receptacles 18 on the home team side 11 of the game board 1.

The "out" game pieces 13 may be used to tally the number of "outs" acquired by the first player and/or the second player during each inning of the game. To tally an "out" when "up to bat", the first player may place the "out" game piece 13 from the first player's game piece rack 40 into one of the "out" receptacles 12 on the visiting team side 10 of the game board 1. Further, to tally an "out" when "up to bat", the second player may place the "out" game piece 13 from the second player's game piece rack 40 into one of the "out" receptacles 14 on the home team side 11 of the game board 1.

Figure 4:
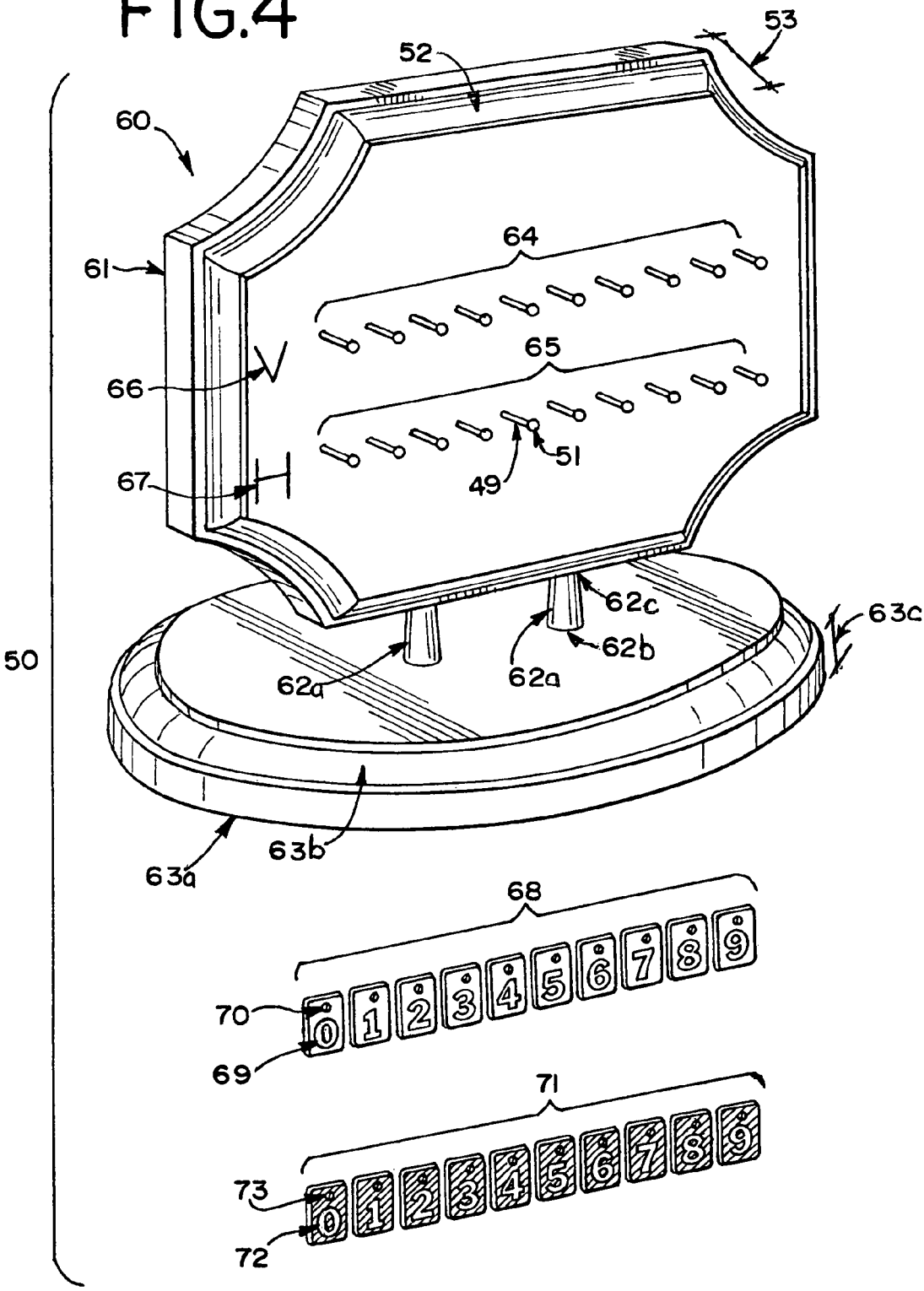
FIG. 4 illustrates a perspective view of a scoreboard in an embodiment of the present invention.

FIG. 4 illustrates an assembly 50 of a scoreboard 60, a set of visiting team tabs 68 and a set of home team tabs 71. The scoreboard 60 may have a panel 61, two legs **62*a* and a base 63*a*. The panel 61 of the scoreboard 60 may be shaped as a square, rectangle, oval or any shape that may display the number of "runs" that may be acquired by each player in each half inning. Further, the panel 61 may have a beveled edge 52 in an embodiment of the game. The panel 61 may have a thickness 53**, or alternatively, may be flat.

The panel 61 of the scoreboard 60 may have a set of visiting team pegs 64 and a set of home team pegs 65. The set of visiting team pegs 64 may be designated with a "V" symbol 66 and the set of home team pegs 65 may be designated with an "H" symbol 67. The set of visiting team pegs 64 and the set of home team pegs 65 may be shaped to have a longitudinal body 49 with a head 51 at an end of the longitudinal body 49 opposite to a point where the longitudinal body 49 attaches to the panel 61.

The legs 62*a* of the scoreboard 60 may be longitudinal bodies that may hold the panel 61 in a vertical position. The legs 62*a* may have a circular, square, rectangular or other cross-sectional shape. Further, the legs 62*a* may attach to the base 63*a* at a first end of the legs 62*a*, and attach to the panel 61 opposite to the first end of the legs 62*a*.

The base 63*a* of the scoreboard 60 may be shaped as a square, rectangle, oval or any shape that may support the panel 61 via the legs 62*a*. Further, the base 63*a* may have a beveled edge 63*b* in an embodiment of the game. The base 63*a* may have a thickness 63*c*, or may be flat. The panel 61, the legs 62*a* and the base 63*a* may be made from plastic, wood, metal, cardboard, or the like.

The set of visiting team tags 68 may be provided, from which the first player may select particular tags and may hang the particular tags on the set of visiting team pegs 64. Each tag from the set of visiting team tags 68 may have a number 69 between zero and nine. Further, each tag from the set of visiting team tags 68 may have a hole 70 for hanging on a peg from the set of visiting team pegs 64. At the conclusion of each "up to bat", the first player may hang a particular tag from the set of visiting team tags 68 sequentially on a peg from the set of visiting team pegs 64 that may correspond with the number of "runs" the first player may have acquired during each inning, which may be counted at the conclusion of each inning, from the number of "run" game pieces 17 that may have been deposited in the "run" receptacles 16. The particular tags that may be selected and hung may tally the total number of "runs" acquired by the first player during the game.

The set of home team tags 71 may be provided, from which the second player may select particular tags and may hang the particular tags on the set of home team pegs 65. Each tag from the set of home team tags 71 may have a number 72 between zero and nine. Further, each tag from the set of home team tags 71 may have a hole 73 for hanging on a peg from the set of home team pegs 65. At the conclusion of each "up to bat", the second player may hang a particular tag from the set of home team tags 71 sequentially on a peg from the set of home team pegs 65 that may correspond with the number of "runs" the second player may have acquired during each inning, which may be counted at the conclusion of each inning, from the number of "run" game pieces 17 that may have been deposited in the "run" receptacles 18. The particular tags that may be selected and hung may tally the total number of "runs" acquired by the second player during the game.

The set of visiting team tags 68 may be a different color than the set of home team tags 71 so that the first player and the second player may differentiate between the tags. Further, in an embodiment of the game, multiple sets of visiting team tags 68 and multiple sets of home team tags 71 may be provided to the first player and the second player, respectively. The visiting team tags 68 and the home team tags 71 may be made from plastic, wood, metal, cardboard, cloth, or the like and may be any shape that may hang from a peg and may have a number that may represent the number of "runs" accumulated in the inning.

In an embodiment of the game, the visiting team tags 68 and the home team tags 71 may have back sides that may be magnetic. Further, the panel 61 of the scoreboard 60 may have sets of metal positions (not shown) in lieu of the set of visiting team pegs 64 and the set of home team pegs 65. The sets of metal positions may be circular, square, rectangular, or the like, and may be inlaid into the surface of the panel 61 and/or may stand out from the surface of the panel 61. The visiting team tags 68 and the home team tags 71 with magnetic backing may be placed on the sets of metal positions when the game is played to tally the number of "runs" scored in each half-inning.

In a preferred embodiment of the game, the scoreboard 60 may be separate from the game board 1. In an alternate embodiment of the game, the panel 61 of the scoreboard 60 may be positioned horizontally to store within a cavity within the thickness 15 of the game board 1 when the game may be stored. When the game is played, the panel 61 may have one or more legs 62*a*, 62*b* that may support the panel 61 above the game board 1. The legs 62*a*, 62*b* may be attached to the top surface of the game board 1 via adhesive, magnet, velcro, or may be placed into cavities within the thickness 15 of the game board 1. Further, the panel 61 of the scoreboard 60 may be configured to pivot on the game board 1.

Figure 5:
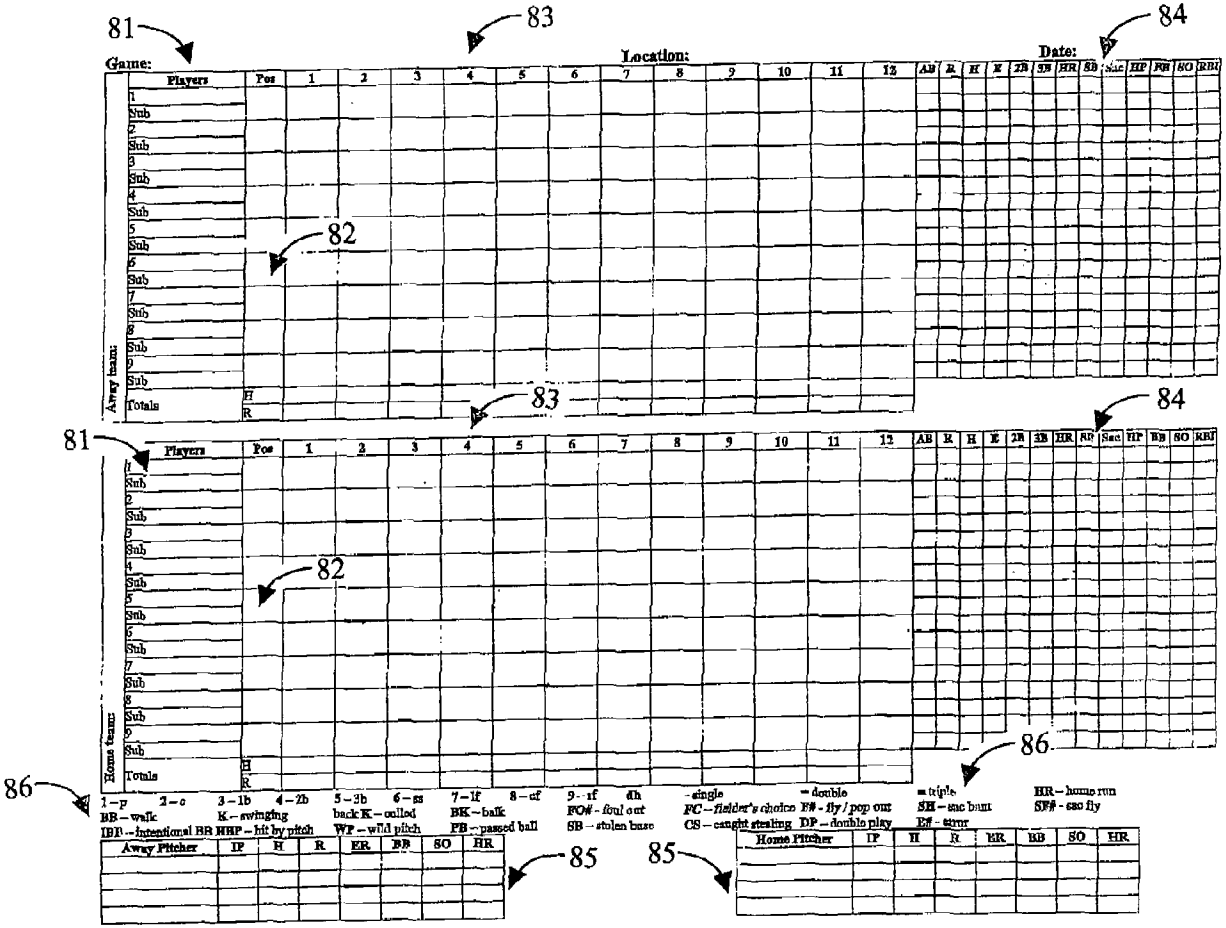
FIG. 5 illustrates a scorecard in an embodiment of the present invention.

FIG. 5 represents a scorecard 80, which may have a list of players 81, a list of field positions 82, play-recording areas 83, event-recording areas 84, pitcher performance recording areas 85, and an area defining abbreviations 86. The list of players 81 may have names of batters in an order according to which the batters may be "up to bat". The list of field positions 82 may have catcher, pitcher, first base, second base, short stop, third base, right field, left field, and center field. The play-recording areas 83 may have a series of boxes to record each occurrence of the game.

The event-recording areas 84 may have a series of boxes to record an event associated with each player. The events that may be recorded are "at bat", "run", "hit", "error", "double hit", "triple hit", "home run", "squeeze bunt", "sacrifice bunt or fly", "hit player", "walk", "strike out", and "runner batted in". The pitcher performance recording areas 85 may have a series of boxes that may tally data that may reflect the performance of a pitcher, which may involve "inning pitched", "hit", "run", "earned runs", "walk", "strike out" and "home run".

The area defining abbreviations 86 may be a guide for recording information in the play recording areas 83. The abbreviations may have "1" to designate the pitcher's position, "2" to designate the catcher's position, "3" to designate the first base position, "4" to designate the second base position, "5" to designate the third base position, "6" to designate the shortstop position, "7" to designate the left field position, "8" to designate the center field position, "9" to designate the right field position, "DH" to designate a designated hitter, "HR" to designate a home run, "BB" to designate a walk, "K" to designate a swinging strike out, a backwards "K" to designate a called strike out, "BK" to designate a balk, "FO" to designate a foul out, "FC" to designate fielder's choice, "F" to designate a fly or pop-up hit, "SH" to designate a sacrifice bunt, "SF" to designate a sacrifice fly, "IBB" to designate an intentional walk, "HBP" to designate hit by pitch, "WP" to designate a wild pitch, "PB" to designate a passed ball, "SB" to designate a stolen base, "CS" to designate caught stealing, "DP" to designate a double play, and "E" to designate an error.

The scorecard 80 may have alternate arrangements of the areas on the scorecard 80 and may have additional characteristics about the game of baseball. The scorecard 80 may be produced in any size and with any visual enhancements and may be made of cardboard, paper, or the like. When the game is played, the scorecard 80 may be used by the first player and/or the second player to record the plays and the score of the game.

Figure 6:
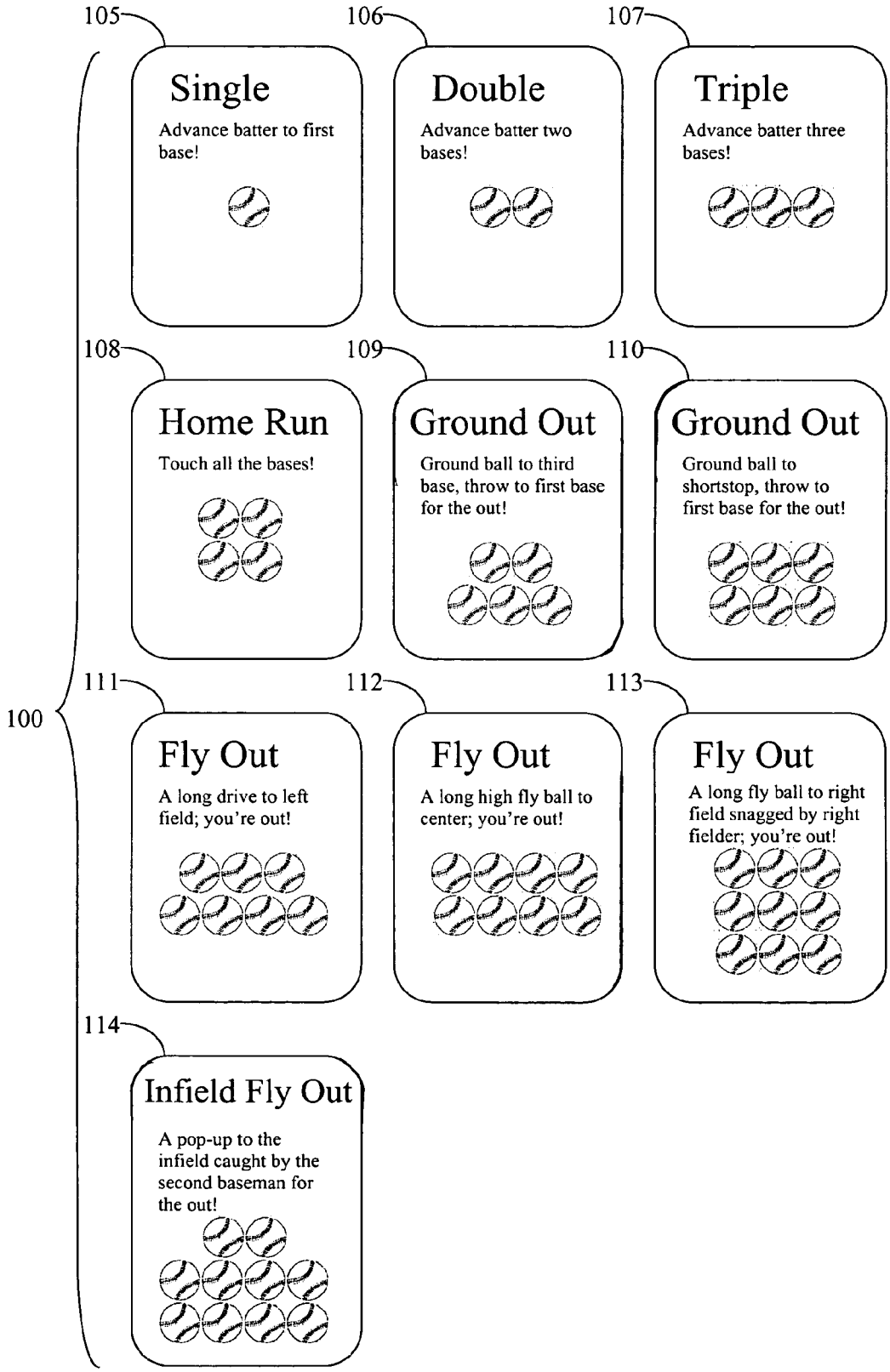
FIG. 6 illustrates a top view of batting playing cards in an embodiment of the present invention.

FIG. 6 illustrates the set of batting playing cards 100. Multiple sets of the batting playing cards 100 may be used by the visiting team side 10 and the home team side 11. The visiting team side 10 may have sets of batting playing cards 100 that are a different color than the sets of batting playing cards 100 used by the home team side 11. As a result, the first player and the second player may differentiate between the cards. The set of batting playing cards 100 may have a "single" card 105, a "double" card 106, a "triple" card 107, a "home run" card 108, "ground out" cards 109 and 110, "fly out" cards 111, 112 and 113, and an "infield fly out" card 114.

When the game is played, the first player may be first "up to bat" and may designate one of the player game pieces 21 as "batting" and may place the player game piece 21 on the game board 1 in accordance with the direction of the cards. As other player game pieces 21 may be brought up to bat, one at a time, player game pieces 21 previously placed on any base position may advance around the bases according to the rules of baseball and as directed by the cards that may be revealed.

The first player may begin revealing cards from a first deck that may have multiple sets of batting playing cards 100 shuffled, or mixed, together. The first player may reveal the "single" card 105 and may place the player game piece 21 on the first base position 5. The first player may reveal the "double" card 106 and may place the player game piece 21 on the second base position 6*a*. Further, the first player may reveal the "triple" card 107 and may place the player game piece 21 on the third base position 7. The first player may reveal the "home run" card 108 and may accumulate a "run". Each player game piece 21 previously placed on any base position may also be counted as a "run".

Moreover, the first player may reveal one of the "ground out" cards 109 or 110, one of the "fly out" cards 111, 112 or 113, and/or the "infield fly out" card 114 and may accumulate an "out" associated with the player game piece 21 designated as "batting". After the first player has accumulated three "outs", the second player associated with the home team side 11 may be "up to bat" and may begin revealing cards from the set of batting playing cards 100 shuffled, or mixed, together.

The second player may designate one of the player game pieces 21 as "batting" and may place the player game piece 21 on the game board 1 in accordance with the direction of the cards. As other player game pieces 21 may be brought up to bat, one at a time, player game pieces 21 previously placed on any base position may advance around the bases according to the rules of baseball and as directed by the cards that may be revealed.

The second player may reveal the "single" card 105 and may place the player game piece 21 on the first base position 5. The second player may reveal the "double" card 106 and may place the player game piece 21 on the second base position 6*a*. Further, the second player may reveal the "triple" card 107 and may place the player game piece 21 on the third base position 7. The second player may reveal the "home run" card 108 and may accumulate a "run" with respect to the player game piece 21 designated as "up to bat". Each player game piece 21 previously placed on any base position may also be counted as a "run".

Moreover, the second player may reveal one of the "ground out" cards 109 or 110, one of the "fly out" cards 111, 112 or 113, and/or the "infield fly out" card 114 and may accumulate an "out" associated with the player game piece 21 designated as "batting". After the second player has accumulated three "outs", the first player may be "up to bat" again; a process that may be repeated nine times, according to the rules of baseball, or as many times as desired by the players. Each time the first player or the second player accumulates three "outs", the player may record a number of "runs" scored on the scoreboard 60. After nine innings, the player who has accumulated a greater total number of "runs" may be declared the winner.

Figure 7:
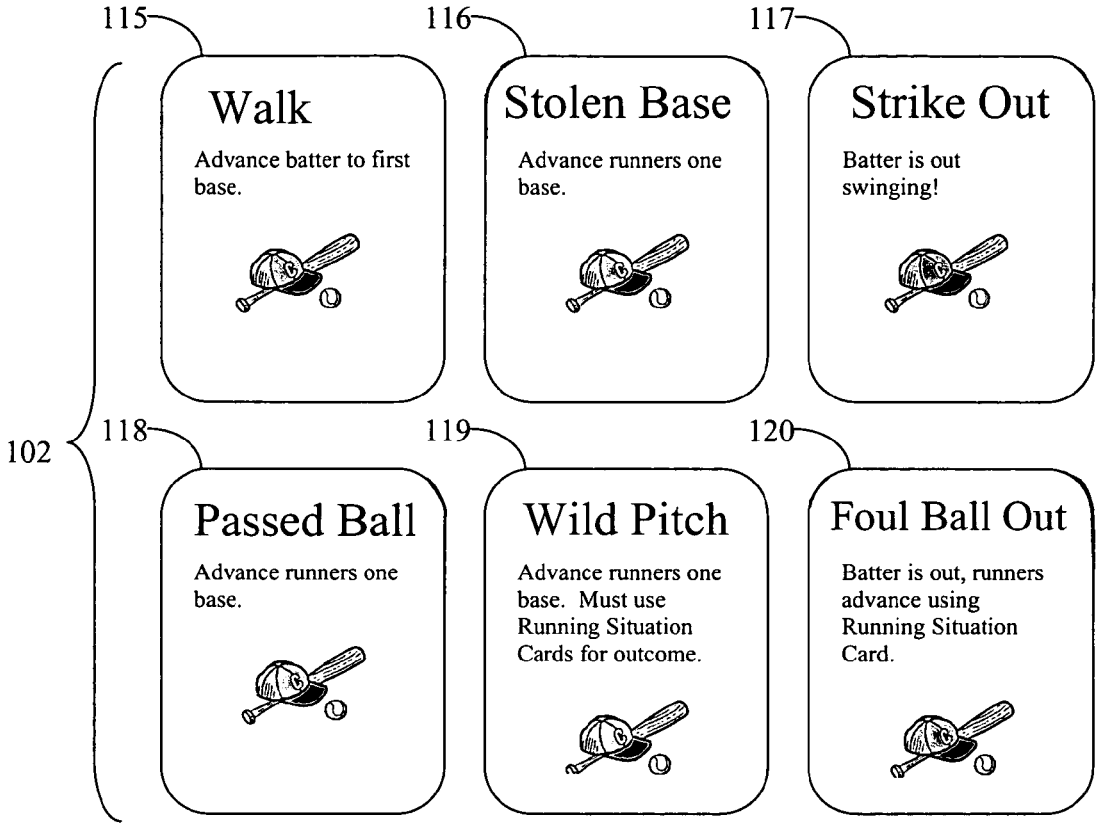
FIG. 7 illustrates a top view of situation playing cards in an embodiment of the present invention.

FIG. 7 illustrates a set of situation playing cards 102 that may be played by the first player when "up to bat" or the second player when "up to bat" at any time during play of the game. The set of situation playing cards 102 may have a "walk" card 115, a "stolen base" card 116, a "strike out" card 117, a "passed ball" card 118, a "wild pitch" card 119, and a "foul ball out" card 120. The first player or the second player may reveal the "walk" card 115 and may place the player game piece 21 on the first base position 5. The first player or the second player may reveal the "stolen base" card 116 and may advance any player game piece 21 previously placed on any base position a base position. Further, the first player or the second player may reveal a "strike out" card 111 and may acquire an "out".

Moreover, the first player or the second player may reveal the "passed ball" card 118 and may advance any player game piece 21 previously placed on any base position a base position. Further, the first player or the second player may reveal the "wild pitch" card 119 and may advance any player game piece 21 previously placed on any base position in accordance with a card from a set of running situation cards 131, described below. Finally, the first player or the second player may reveal the "foul ball out" card 120 and may accumulate an "out" associated with the player game piece 21 designated as "batting", but may advance any player game piece 21 previously placed on any base position in accordance with a card from the set of running situation cards 131.

Figure 8:
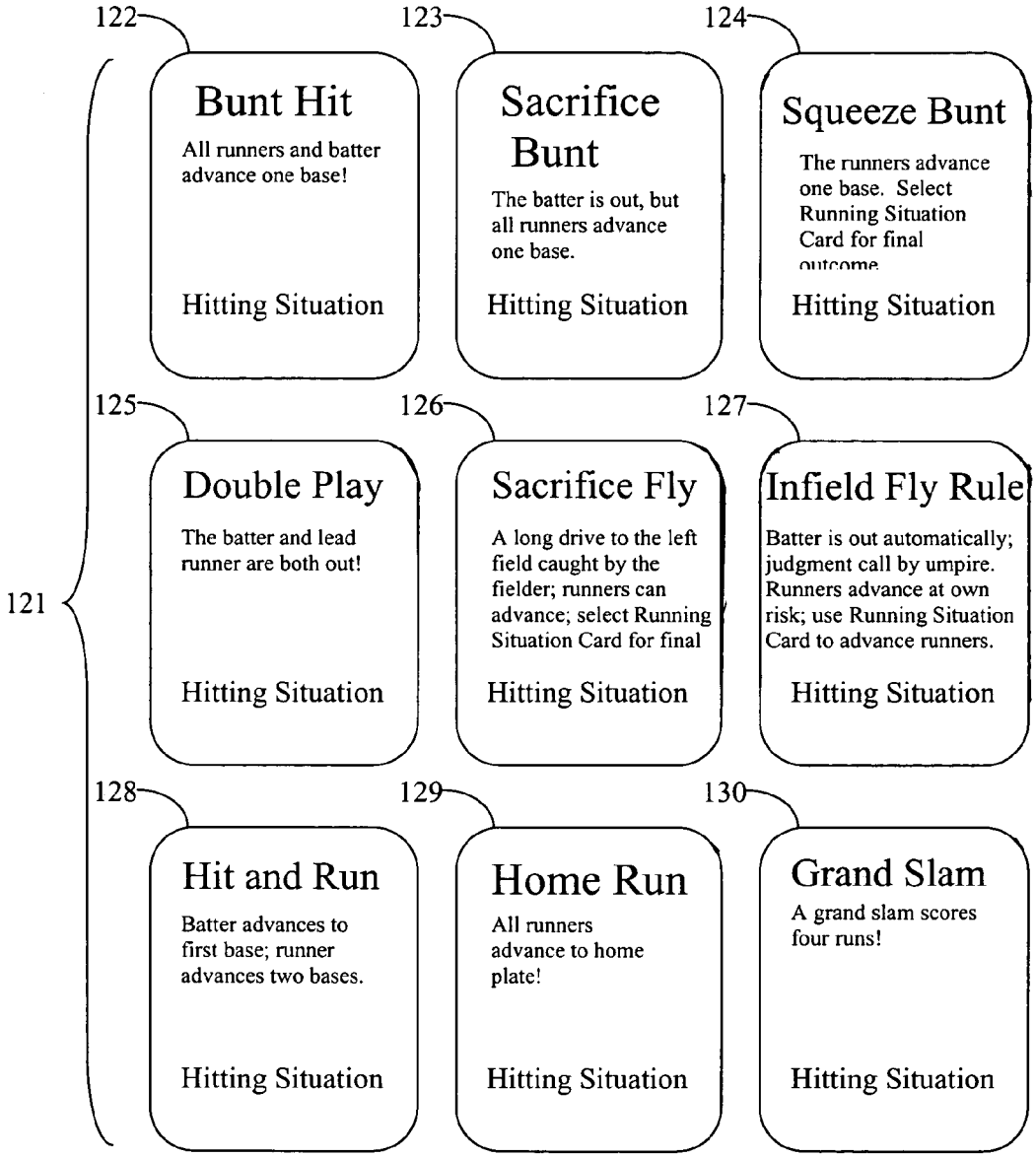
FIG. 8 illustrates a top view of hitting situation playing cards in an embodiment of the present invention.

FIG. 8 illustrates a set of hitting situation playing cards 121 in an embodiment of the game. The set of hitting situation playing cards 121 may be played by the first player when "up to bat" or the second player when "up to bat" during play of the game. The set of hitting situation playing cards 121 may have a "bunt hit" card 122, a "sacrifice bunt" card 123, a "squeeze bunt" card 124, a "double play" card 125, a "sacrifice play" card 126, an "infield fly rule" card 127, a "hit and run" card 128, a "home run" card 129, and a "grand slam" card 130.

The first player or the second player may reveal the "bunt hit" card 122 and may place the player game piece 21 on the first base position 5. Further, the first player or the second player may reveal the "sacrifice bunt" card 123 and may accumulate an "out" with respect to the player game piece 21 designated as "up to bat", but may advance any player game piece 21 previously placed on any base position a base position. Still further, the first player or the second player may reveal the "squeeze bunt" card 124 and may advance the player game piece 21 designated as "up to bat" and may advance any player game piece 21 previously placed on any base position in accordance with a card from the set of running situation cards 131.

The first player or the second player may reveal the "double play" card 125 and may accumulate two "outs"; one with regard to the player game piece 21 designated as "up to bat" and one with regard to the lead player game piece 21 on a base position. Moreover, the first player or the second player may reveal the "sacrifice fly" card 126 or the "infield fly rule" card 127 and may accumulate one "out" with regard to the player game piece 21 designated as "up to bat" and may advance any player game piece 21 previously placed on any base position in accordance with a card from the set of running situation cards 131.

The first player or the second player may reveal the "hit and run" card 128 and may place the player game piece 21 on the first base position 5 and may advance any player game piece 21 previously placed on any base position two base positions. Further, the first player or the second player may reveal the "home run" card 129 and may accumulate a "run" with respect to the player game piece 21 designated as "up to bat". Each player game piece 21 previously placed on any base position may also be counted as a "run". Still further, the first player or the second player may reveal the "grand slam" card 130 and may accumulate four "runs" with respect to the player game piece 21 designated as "up to bat" and any player game piece 21 previously placed on any base position.

Figure 9:
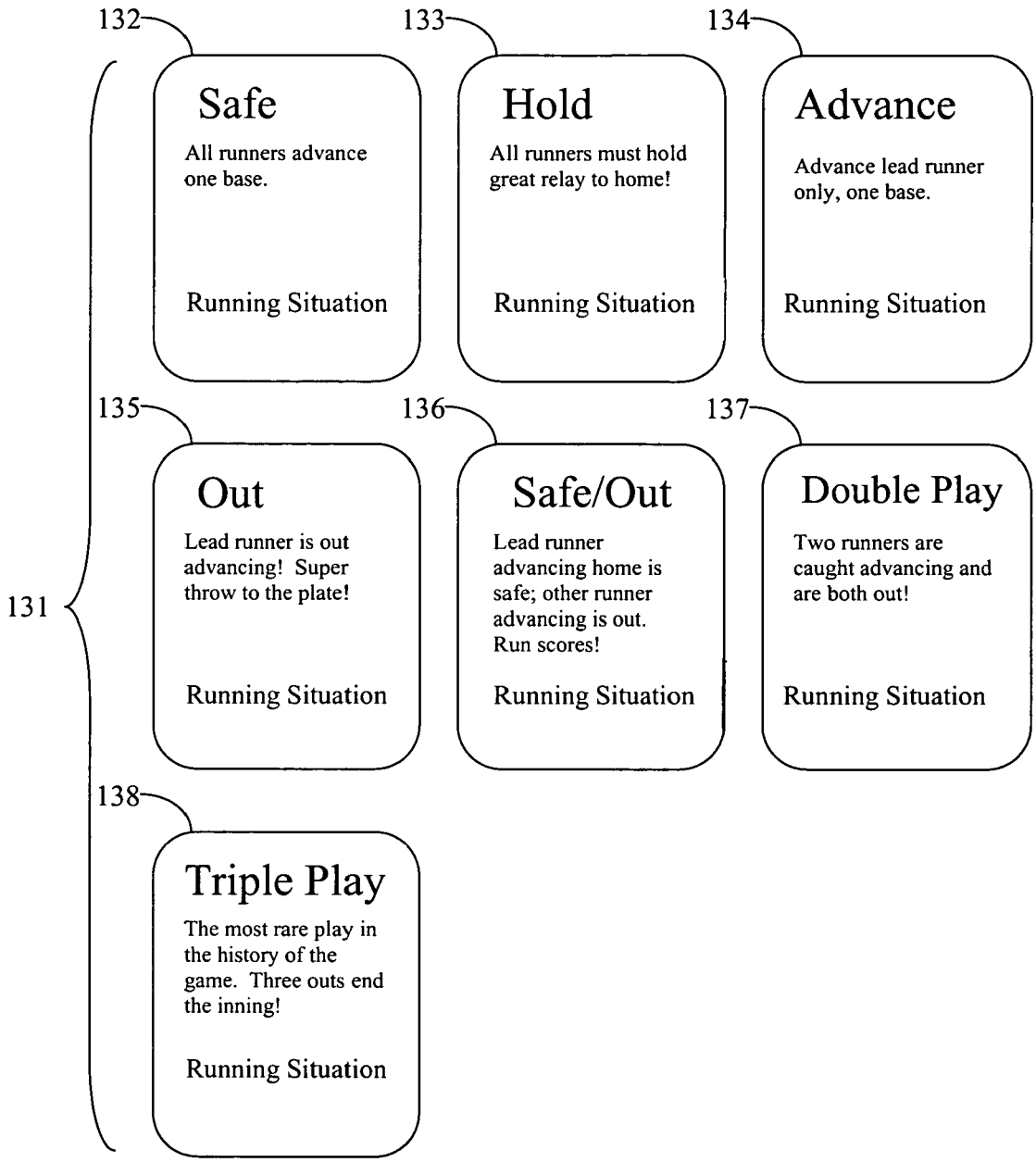
FIG. 9 illustrates a top view of running situation playing cards in an embodiment of the present invention.

FIG. 9 illustrates the set of running situation playing cards 131 in an embodiment of the game. The set of running situation playing cards 131 may have a "safe" card 132, a "hold" card 133, an "advance" card 134, an "out" card 135, a "safe/out" card 136, a "double play" card 137, and a "triple play" card 138.

The first player or the second player may reveal the "safe" card 132 and may advance any player game piece 21 previously placed on a base position one base position. Further, the first player or the second player may reveal the "hold" card 133 and may leave any player game piece 21 previously placed on a base position at that position. Still further, the first player or the second player may reveal the "advance" card 134 and may advance the lead player game piece 21 on a base position one base position.

The first player or the second player may reveal the "out" card 135 and may accumulate one "out" with regard to the lead player game piece 21 previously placed on a base position. Further, the first player or the second player may reveal the "safe/out" card 136 and may accumulate a "run" with regard to the lead player game piece 21 previously placed on a base position and may accumulate an "out" with regard to any other player game piece 21 previously placed on a base position. Still further, the first player or the second player may reveal the "double play" card 137 and may accumulate two "outs" with regard to two player game pieces 21 previously placed on a base position. Moreover, the first player or the second player may reveal the "triple play" card 138 and may accumulate three "outs".

The batting playing cards 100, the situation playing cards 102, the hitting situation playing cards 121, and the running situation playing cards 131 may be of any size, shape and/or color that may display the instructions described above and may be made from paper or cardboard that may be laminated, or the like. Further, the reverse side of the batting playing cards 100, the situation playing cards 102, the hitting situation playing cards 121, and the running situation playing cards 131 may be an advertisement or an image related to the game of baseball. The batting playing cards 100, the situation playing cards 102, the hitting situation playing cards 121, and the running situation playing cards 131 may each be a different color so that the first player and the second player may differentiate between the cards. Further, multiple sets of the batting playing cards 100, the situation playing cards 102, the hitting situation playing cards 121, and the running situation playing cards 131 may be used during play of the game.

Figure 10:
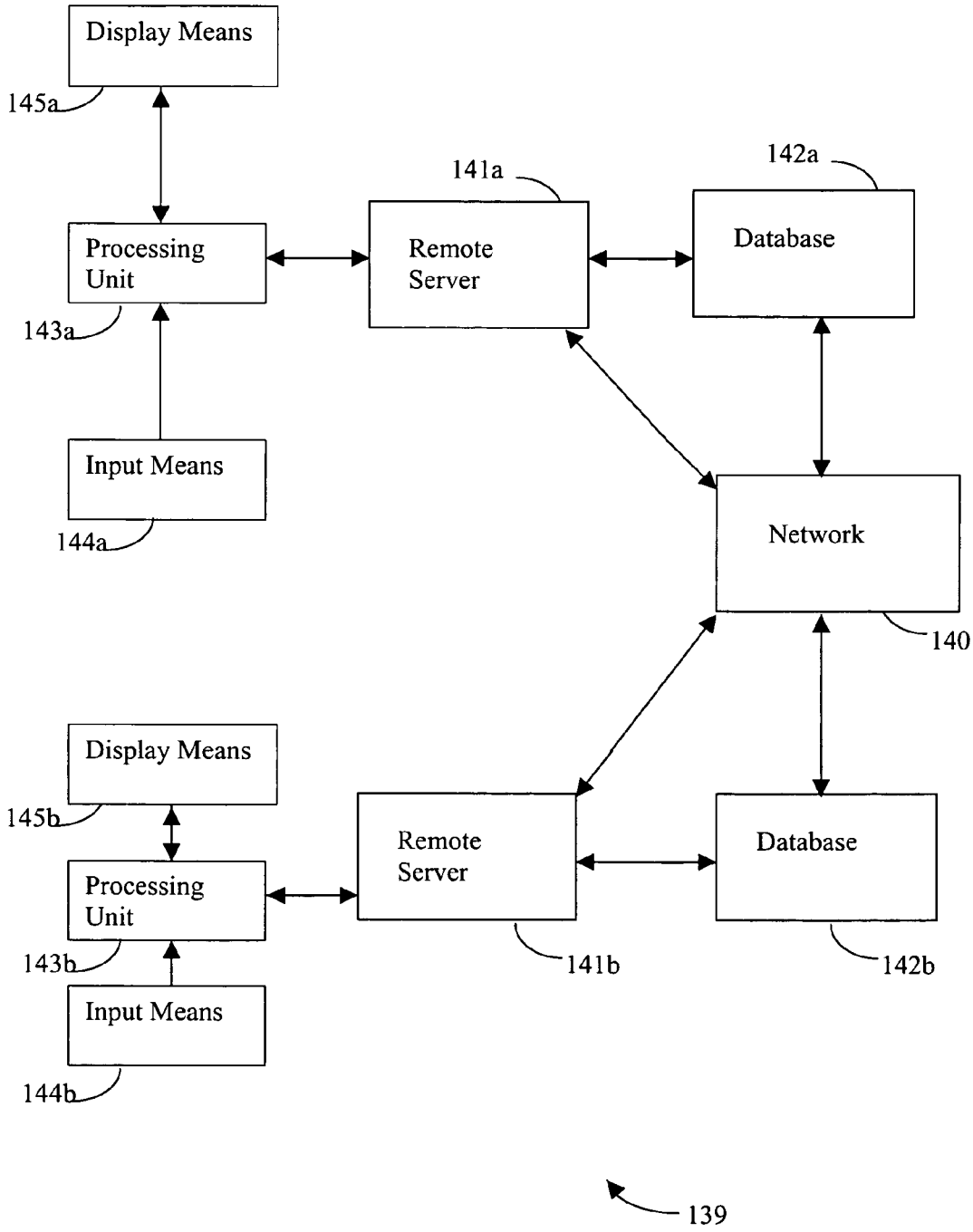
FIG. 10 illustrates a black box diagram of a computer system in an embodiment of the present invention.

FIG. 10 illustrates a black box diagram of a system 139 which may have a network 140, a first remote server 141*a* and/or a second remote server 141*b*. The remote servers 141*a*, 141*b* may be connected by the network 140. The network 140 may be a computer network, such as, for example, the internet. Alternatively, the network 140 may be an intranet such as, for example, within a corporation or a business, such as on a LAN network. The remote servers 141*a*, 141*b* may have a first database 142*a* and/or a second database 142*b*.

The databases 142*a*, 142*b* may be connected to a first processing unit 143*a* and/or a second processing unit 143*b* through the first remote server 141*a* and/or the second remote server 141*b*. The processing units 143*a*, 143*b* may be a computer, such as, for example, a desktop computer, a laptop computer, or the like. Alternatively, the processing units 143*a*, 143*b* may be wireless devices, such as, for example, a Palm Pilot™ device by 3Com, Inc., or a wireless telephone that may access the internet wirelessly.

The processing units 143*a*, 143*b* may be connected to a first input means 144*a* and/or a second input means 144*b*. The input means 144*a*, 144*b* may be a computer device, such as, for example, a mouse, keyboard or joystick. Alternatively, the input means 144*a*, 144*b* may be a part of a wireless device, such as, for example, buttons on a wireless telephone.

Furthermore, the processing units 143*a*, 143*b* may be connected to a first display means 145*a* and/or a second display means 145*b*. The display means 145*a*, 145*b* may be, for example, a computer screen or telephone screen. Alternatively, the display means 145*a*, 145*b* may be, for example, a touch screen wherein a user may communicate with the processing units 143*a*, 143*b* merely by touching the screen of the display means 145*a*, 145*b*.

It should be appreciated that any number of remote computers may be utilized in the network, and the invention should not be construed as limited as herein described. Further, as indicated above, any number of remote servers may be connected having a plurality of databases to create the network 140.

The processing units 143*a*, 143*b* may store information to simulate a game of baseball, such as, for example, images of the baseball park, the scoreboard and the playing cards. Alternatively, the remote servers 141*a*, 141*b* and/or the databases 142*a*, 142*b* may store the data needed to simulate the game of baseball. The game may be viewed by a player of the game (not shown), a person, by the display means 150. The player of the game may reveal simulated batting playing cards 100, simulated situation playing cards 102, simulated hitting situation playing cards 121, and simulated running situation playing cards 131 by the input means 144*a*, 144*b*. The system 139 may use processing units 143*a*, 143*b* to process data and/or information received from the player of the game. The player of the game inputs information and/or data to simulate the game using the input means 144*a*, 144*b*. It should be appreciated that multiple players may play the same game at the same time using the same processing unit 143*a* or, for example, a distinct processing unit 143*b*.

Figure 11:
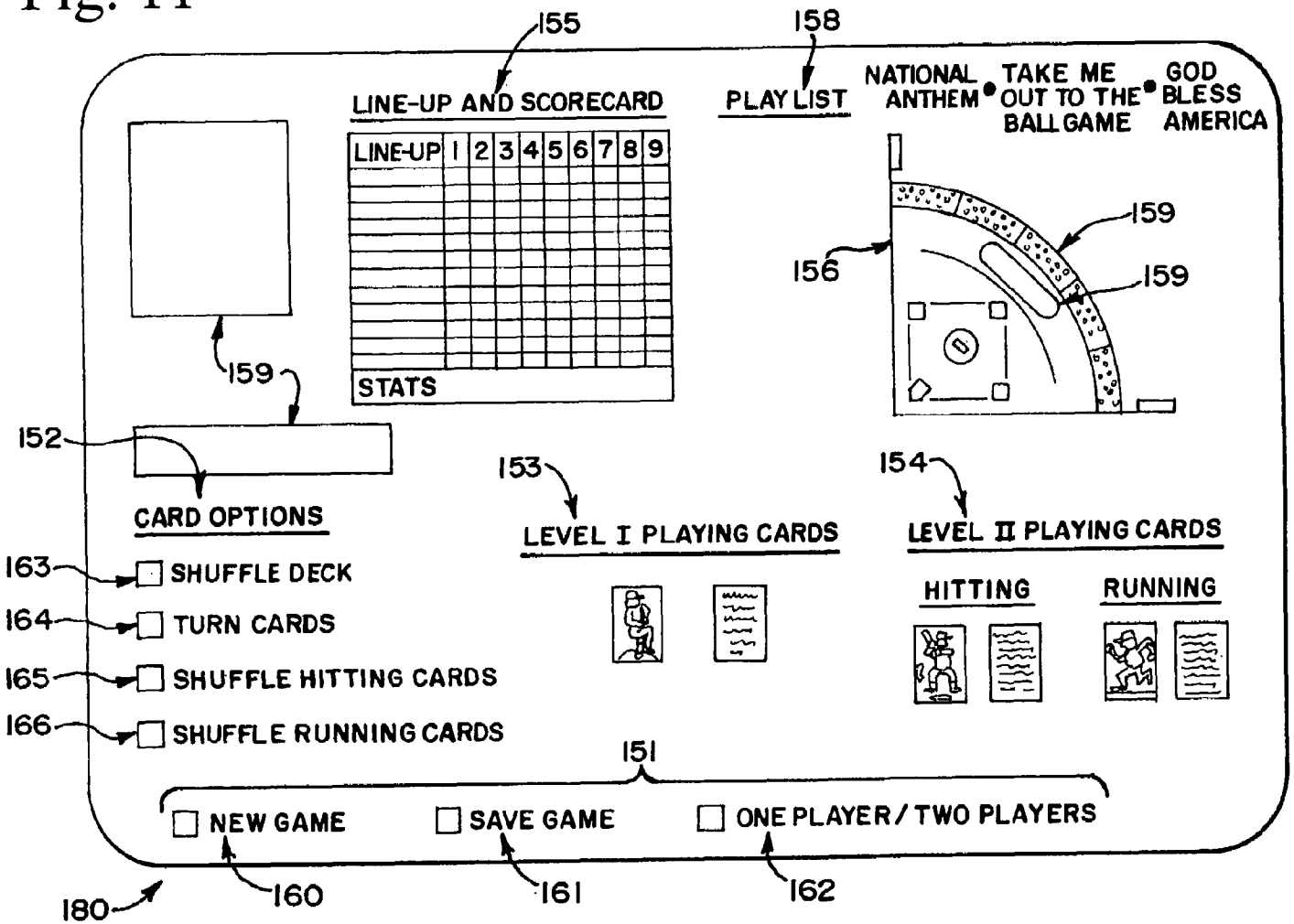
FIG. 11 illustrates a computer display of an embodiment of the present invention.

FIG. 11 illustrates an arrangement 180 of the display means 145*a*, 145*b* in an embodiment of the game. The arrangement 180 may have game controls 151, card option controls 152, Level I playing cards controls 153, Level II playing cards controls 154, an electronic scorecard 155, an electric baseball field 156, an electric scoreboard 157, and baseball song controls 158. The arrangement 180 may also have sponsorship areas 159 that may be used for sponsors to advertise products and/or services. The game controls 151 may have "start new game" 160 that may start a new game, "save game" 161 that may save the status of the game currently being played and "one player/two players" 162 that may select the number of players.

The card option controls 152 may have "shuffle deck" 163 that may simulate shuffling of the batting playing cards 100.

Further, the card option controls 152 may have "turn card" 164 that may display the card at the top of the deck, "shuffle hitting cards" 165 that may simulate shuffling of the hitting situation playing cards 121 and "shuffle running cards" 166 that may simulate shuffling of the running situation playing cards 131.

The Level I playing cards 153 may display the deck as the cards are played. The Level II playing cards 154 may display the hitting situation playing cards 121 and running situation playing cards 131 as the cards are played. The electronic scorecard 155 may automatically keep tally of data traditionally recorded in a manually recorded baseball scorecard. The electronic baseball field 156 may advance runners on base automatically in accordance with the cards sequentially revealed. The electronic baseball field 156 may display hits and/or may display how each hit is fielded. The electronic scoreboard 157 may automatically keep tally of the runs scored by each player during each inning. The baseball song controls 158 may allow the player(s) of the electronic version 150 to select a song to play during the game.

The arrangement 180 of the display means 145*a*, 145*b* may be played according to the guidelines of the board game, except the elements may be programmed and/or may be represented electronically. Other automated features may have the selection and customization of the ball field to resemble major league ball parks, fireworks, fans cheering, and the calculation of player statistics. Player statistics may be saved at the end of a game. Advertising may be provided on the center field, outfield fences, and/or playing cards.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A system for simulating play of a game of baseball, the system comprising:

a game board having a design resembling a baseball field wherein the game board has a substantially planar surface formed on a raised platform wherein the planar surface is formed within a perimeter defined by four sides and a corner wherein the raised platform is supported by walls extending from each of the four sides in a direction below the planar surface wherein the corner is located between a first side and a second side of the perimeter wherein a third side is perpendicular to the first side and a fourth side is perpendicular to the second side wherein a home plate of the baseball field is adjacent to the corner wherein the game board has an infield and an outfield of the baseball field which are located between the home plate and a third side and a fourth side of the perimeter wherein the infield is located between the home plate and the outfield wherein the game board has a first plurality of indents that extend below the substantially planar surface wherein the first plurality of indents is adjacent to the first side, a second plurality of indents that extend below the substantially planar surface wherein the second plurality of indents is adjacent to the second side, a third plurality of indents that extend below the substantially planar surface wherein the third plurality of indents is adjacent to the third side and a fourth plurality of indents that extend below the substantially planar surface wherein the fourth plurality of indents is adjacent to the fourth side wherein each of the first plurality of indents, each of the second plurality of indents, each of the third plurality of indents and each of the fourth plurality of indents are equal in size wherein each of the first plurality of indents, each of the second plurality of indents, each of the third plurality of indents and each of the fourth plurality of indents each extend to a certain depth below the substantially planar surface;

a first game piece shaped to resemble a baseball player;

a plurality of second game pieces shaped to insert into the first plurality of indents, the second plurality of indents, the third plurality of indents and the fourth plurality of indents wherein each of the plurality of second game pieces has a first end, a second end, a height and a diameter wherein the first end is in a position opposite to the second end and the height is defined by a distance between the first end to the second end wherein the first end is sized to match the size of each of the first plurality of indents, each of the second plurality of indents, each of the third plurality of indents and each of the fourth plurality of indents and further wherein the height is larger than the diameter and larger than the depth of each of the indents below the substantially planar surface;

a scoreboard to record runs scored by the first game piece wherein the scoreboard has metal;

magnetic tiles that attach to the scoreboard; and a first set of playing cards having offensive cards and defensive cards wherein the offensive cards affect advancement of the first game piece on the baseball field wherein the defensive cards deter the advancement of the first game piece on the baseball field wherein each of the offensive playing cards display first indicia which describe a first event in the game of baseball and each of the defensive playing cards display a second indicia which describe a second event in the game of baseball.

2. The system of claim 1 wherein the first plurality of indents has at least nine indents adjacent to the first side and the second plurality of indents has at least nine indents adjacent to the second side.

3. The system of claim 1 further comprising:

a container to house the plurality of second game pieces wherein the container has a first end and a second end wherein the first end of the container contacts the first end of the second game piece and the second end of the container contacts the second end of the second game piece.

4. The system of claim 1 wherein the plurality of second game pieces has at least nine second game pieces shaped to insert into the first plurality of indents, the second plurality of indents, the third plurality of indents and the fourth plurality of indents.

5. The system of claim 1 further comprising:

indicia on the game board shaped to resemble baseball bases to track the progress of the first game piece on the game board wherein the first game piece has a magnet to attach the first game piece to the indicia.

6. The system of claim 1 further comprising:

pegs on the scoreboard; and tiles wherein each of the tiles has a hole to connect to the pegs on the scoreboard.

7. The system of claim 1 further comprising:

a base of the scoreboard wherein the base of the scoreboard is not attached to the game board.

8. The system of claim 1 wherein the second game pieces are shaped to resemble baseball bats.

* * * * *